US006015324A

United States Patent [19]

Potter

[11] Patent Number: 6,015,324

[45] Date of Patent: Jan. 18, 2000

[54] FABRICATION PROCESS FOR SURFACE ELECTRON DISPLAY DEVICE WITH ELECTRON SINK

[75] Inventor: Michael D Potter, Churchville, N.Y.

[73] Assignee: Advanced Vision Technologies, Inc., W. Henrietta, N.Y.

[21] Appl. No.: 08/964,987

[22] Filed: Nov. 5, 1997

Related U.S. Application Data

[60] Provisional application No. 60/033,787, Dec. 30, 1996, and provisional application No. 60/033,788, Dec. 30, 1996.

[51] Int. Cl.[7] ..... H01J 9/00

[52] U.S. Cl. ..... 445/24; 445/49; 445/50

[58] Field of Search ..... 445/24, 49, 50, 445/51, 52

[56] References Cited

U.S. PATENT DOCUMENTS

| | | | |
|---|---|---|---|
| 4,728,851 | 3/1988 | Lambe | 313/309 |
| 4,827,177 | 5/1989 | Lee et al. | 313/306 |
| 5,012,153 | 4/1991 | Atkinson et al. | 313/336 |
| 5,144,191 | 9/1992 | Jones et al. | 313/308 |
| 5,214,347 | 5/1993 | Gray | 313/355 |
| 5,233,263 | 8/1993 | Cronin et al. | 313/309 |
| 5,266,155 | 11/1993 | Gray | 156/651 |
| 5,308,439 | 5/1994 | Cronin et al. | 156/656 |
| 5,548,185 | 8/1996 | Kumar et al. | 313/495 |
| 5,616,061 | 4/1997 | Potter | 445/24 |
| 5,618,216 | 4/1997 | Potter | 445/24 |
| 5,628,663 | 5/1997 | Potter | 445/49 |
| 5,629,580 | 5/1997 | Mandelman et al. | 313/310 |
| 5,630,741 | 5/1997 | Potter | 445/24 |
| 5,644,188 | 7/1997 | Potter | 313/309 |
| 5,644,190 | 7/1997 | Potter | 313/336 |
| 5,647,998 | 7/1997 | Potter | 216/24 |
| 5,666,019 | 9/1997 | Potter | 313/306 |
| 5,669,802 | 9/1997 | Potter | 445/24 |
| 5,700,176 | 12/1997 | Potter | 445/25 |
| 5,703,380 | 12/1997 | Potter | 257/10 |

*Primary Examiner*—Vip Patel
*Assistant Examiner*—Michael J. Smith
*Attorney, Agent, or Firm*—Theodore R. Touw

[57] ABSTRACT

A device useful as a display element has an electron emitter and an anode disposed to receive electrons emitted from the emitter. The anode has surface portions differing in resistivity, providing an electron sink portion at the surface portion of lowest resistivity. A preferred embodiment has a lateral field-emission electron emitter and has an anode formed by processes specially adapted to provide anode portions of differing resistivity, including the electron sink portion. The electron sink portion is preferably disposed at a position laterally spaced apart from the emitting tip of the device's electron emitter. In a particularly preferred fabrication process, the anode is formed by depositing a base layer, depositing and patterning an etch-stop layer with an opening to define the electron-sink portion, forming an opening by etching overlying layers down to the etch-stop layer, and heating the base layer and etch-stop layer to form an anode surface that includes both an integral electron-sink portion and a cathodoluminescent phosphor for emitting light. The fabrication process provides for fabricating a plurality of display element devices to make a flat panel display.

20 Claims, 6 Drawing Sheets

FABRICATION PROCESS FOR SURFACE ELECTRON DISPLAY DEVICE WITH ELECTRON SINK

CROSS-REFERENCE TO RELATED APPLICATIONS

This application is related to Provisional Patent Applications by Michael D. Potter: Ser. No. 60/033,787 titled "Surface Electron Display (SED) Device" and Ser. No. 60/033,788 "Surface Electron Display (SED) Device Fabrication Process," both filed in the United States Patent and Trademark Office on Dec. 30, 1996. This application is also related to application Ser. No. 08/964,483 by Michael D. Potter titled "Surface Electron Display Device with Electron Sink" filed Nov. 5, 1997, now U.S. Pat. No. 5,872,421.

FIELD OF THE INVENTION

This invention relates generally to field-emission devices and fabrication processes therefor, and more particularly to a surface electron display device structure with an anode having an electron sink, fabricated by specially adapted processes.

BACKGROUND OF THE INVENTION

Many field-emission device structures, including diodes, triodes, and tetrodes, have been developed for use in electronic circuits. Some of the field-emission devices have been adapted specifically for use in displays. In such displays, each pixel cell uses one or more field-emission devices. Field-emission displays are considered an attractive alternative and replacement for flat-panel liquid crystal displays, because of their lower manufacturing cost and lower complexity, lower power consumption, higher brightness, and improved range of viewing angles. There is a continuing need for improved device cell structures and fabrication processes for flat panel displays.

NOTATION AND NOMENCLATURE

In this specification, the term "lateral" refers generally to a direction parallel to a substrate on which an electronic device is formed. Thus a "lateral field-emission device" refers to a field-emission device formed on a substrate and formed with a structure such that an anode is spaced apart from a field emitter along at least a direction parallel to the substrate. Similarly, the term "lateral emitter" refers to a field emitter made substantially parallel to the substrate of a lateral device, whereby emission of electrons toward the anode occurs generally parallel to the substrate. Examples of such lateral emitters formed of thin films are known in the related art. The term "electron sink" refers to a region on a surface where electrons of a current tend to flow into the surface. Such electron sink regions are described in detail hereinbelow.

DESCRIPTION OF THE RELATED ART

Many field-emission device structures are known, of which it appears a majority have been generally of the Spindt type, as described for example in U.S. Pat. No. 3,755,704. The following U.S. patents describe various field emission devices having lateral field emitters and/or their fabrication processes: Cronin et al. U.S. Pat. Nos. 5,233,263 and 5,308,439; Xie et al. U.S. Pat. No. 5,528,099; and Potter U.S. Pat. Nos. 5,616,061, 5,618,216, 5,628,663, 5,630,741, 5,644,188, 5,644,190, 5,647,998, 5,666,019, and 5,669,802.

U.S. Pat. No. 5,543,684 to Kumar et al. describes a field emission cathode which includes a substrate and a conductive layer disposed adjacent the substrate. An electrically resistive pillar is disposed adjacent to the conductive layer, the resistive pillar having a substantially flat surface spaced from and substantially parallel to the substrate. A layer of diamond is disposed adjacent the surface of the resistive pillar.

U.S. Pat. No. 5,548,185 to Kumar et al. describes a flat panel display including a plurality of corresponding light-emitting anodes and field-emission cathodes, each of the cathodes including a layer of low work function material having a relatively flat electron emission surface which includes a plurality of electron emission sites and a grid assembly positioned between the anodes and cathodes to control emission to the anodes from the corresponding cathodes. The grid assembly includes a conductive layer deposited between the plurality of anodes and cathodes and over interstices between the cathodes, the conductive layer having apertures therein, the cathodes being aligned with, and of the same size as, the apertures.

U.S. Pat. No. 5,659,224 to Kumar et al. describes a cold cathode display device which includes a cathode having a layer of conductive material and a layer of low-effective work function material deposited over the conductive material wherein the low-effective work function material has an emission surface comprising a plurality of distributed localized electron emission sites, which may have electrical properties which are discontinuous from each other. The emission surface may be relatively flat. U.S. Pat. No. 5,558,554 to Finklea, et al. describes a method for fabricating a field-emission device anode having a multiplicity of grooves for use in a field-emission flat panel display.

U.S. Pat. No. 5,449,970 to Kumar et al. describes a matrix-addressed diode flat panel display of field-emission type which utilizes a diode (two terminal) pixel structure. The flat panel display includes a cathode assembly having a plurality of cathodes. Each cathode includes a layer of cathode conductive material and a layer of a low effective work-function material deposited over the cathode conductive material. The flat panel display includes an anode assembly having a plurality of anodes, each anode including a layer of anode conductive material and a layer of cathodoluminescent material deposited over the anode conductive material. The anode assembly is located proximate the cathode assembly to receive charged particle emissions from the cathode assembly,and the cathodoluminescent material emits light in response to the charged particle emissions. The flat panel display of U.S. Pat. No. 5,449,970 further includes the capability for selectively varying field emission between the plurality of corresponding light-emitting anodes and field-emission cathodes to effect an addressable grey-scale operation of the flat panel display.

PROBLEMS SOLVED BY THE INVENTION

In many field-emission display cells available in the art, light emission from a cathodoluminescent phosphor occurs from only a narrow region of the phosphor near the vicinity of the electron emitting tip or edge, and that narrow light-emitting region is often not fully visible to the user from a wide range of viewing angles. There has been a continuing need for improved effective "fill factor," i.e. the fraction of the display cell area from which light emission occurs, for improved brightness and for an improved range of viewing angles.

PURPOSE, OBJECTS, AND ADVANTAGES OF THE INVENTION

The purpose of the invention is a flat panel display having a plurality of display cells, each cell having improved brightness and fill factor. To achieve this purpose, an object of the invention is a display cell useful for such displays, having an anode with nonuniform resistivity. A more specific object is an anode for a field-emission device having at least one region of relatively lower resistivity compared to the remainder of the anode, providing an electron sink region. A related object is such an anode formed with a phosphor surface. Another related object is such an anode in which the electron sink region is formed integrally in the surface of the anode and is laterally spaced away from the emitting edge of the device's electron emitter. Yet another object is a fabrication process specially adapted for making the improved display device structure. A related object is a fabrication process suitable for simultaneous fabrication of a plurality of individual display devices in an array to form a flat panel display. These and other purposes, objects, and advantages will become clear from a reading of the following portions of this specification along with the accompanying drawings.

SUMMARY OF THE INVENTION

A device useful as a display element has an electron emitter and an anode disposed to receive electrons emitted from the emitter. The anode has surface portions differing in resistivity, providing an electron sink portion at the surface portion of lowest resistivity. A preferred embodiment has a lateral field-emission electron emitter and has an anode formed by processes specially adapted to provide anode portions of differing resistivity, including the electron sink portion. The electron sink portion is preferably disposed at a position laterally spaced apart from the emitting tip of the device's electron emitter. In a particularly preferred process, the anode is formed by depositing a base layer, depositing and patterning an etch-stop layer with an opening to define the electron-sink portion, forming an opening by etching overlying layers down to the etch-stop layer, and heating the base layer and etch-stop layer to form an anode surface that includes both an integral electron-sink portion and a cathodoluminescent phosphor for emitting light. The fabrication process provides for fabricating a plurality of display element devices to make a flat panel display.

DETAILED DESCRIPTION OF THE PREFERRED EMBODIMENTS

Figure 1:
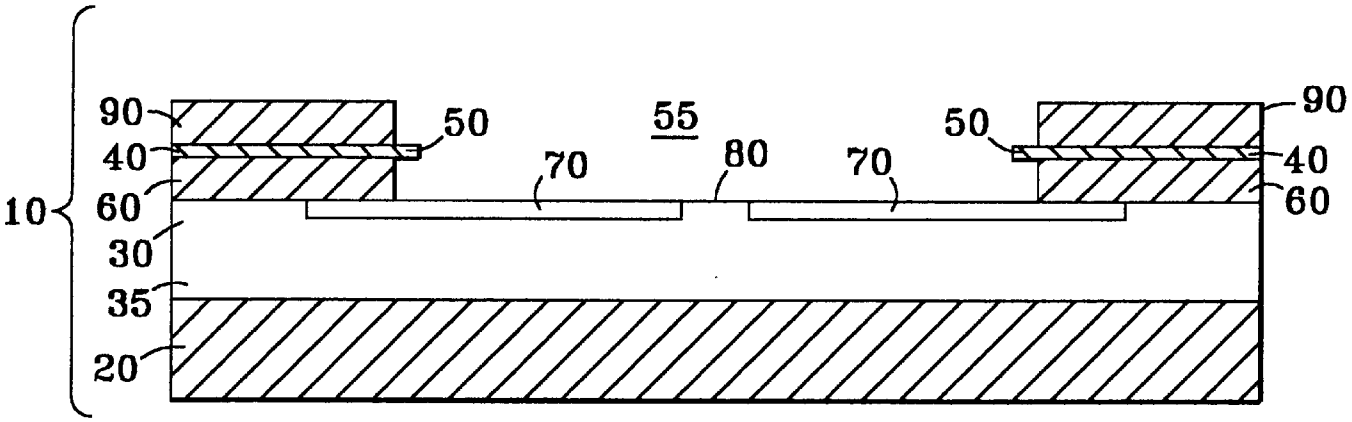
FIG. 1 shows a side elevation cross-sectional view of a field-emission device made in accordance with the invention.

The surface electron display device and a fabrication process specially adapted to make the device are described below with reference to the accompanying drawings, in which the same reference numerals refer to the same or similar elements. For clarity, process steps are designated hereinbelow and in the drawings by reference numerals beginning with the letter "S," e.g. S1, . . . , S8.

Figure 5:
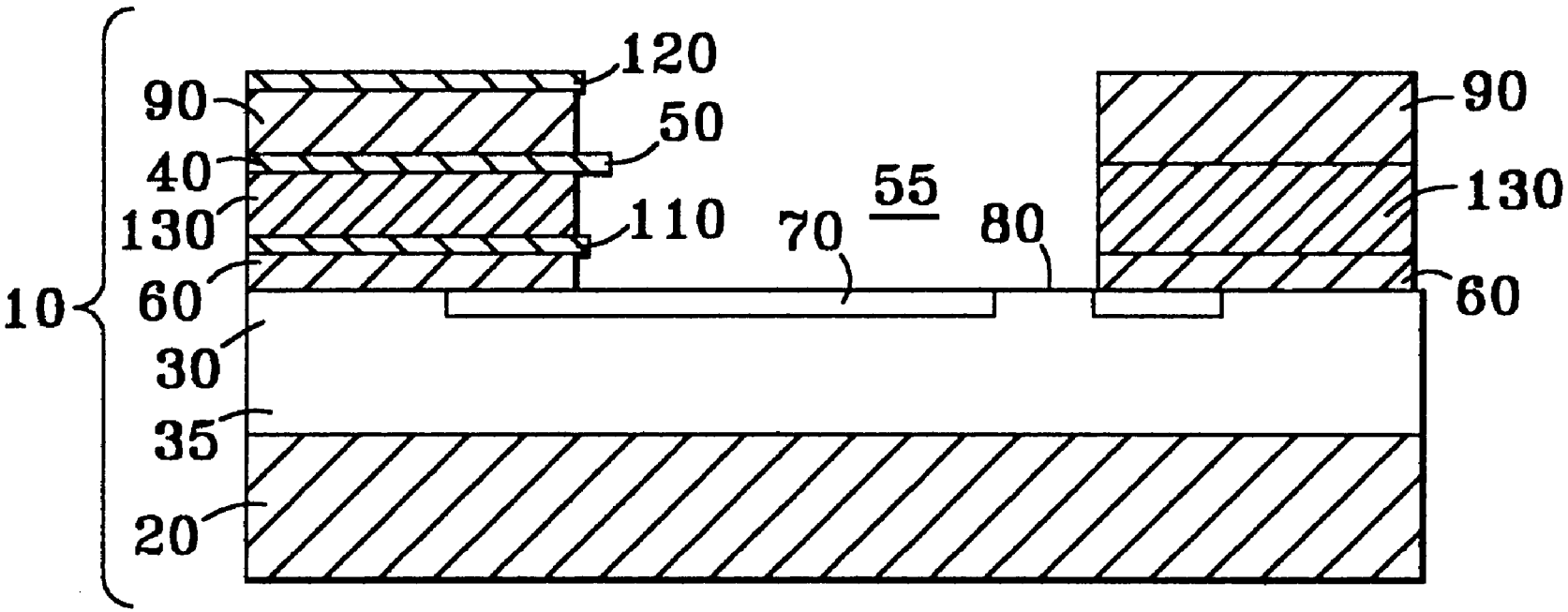
FIG. 5 shows a side elevation cross-sectional view of an alternate embodiment of a field-emission device made in accordance with the invention.

FIG. 1 shows a side elevation cross-sectional view of a field-emission device (generally denoted by reference numeral 10) made in accordance with the invention. The device has a substrate 20. A composite anode 30 receives electrons emitted from a field emitter 40 when suitable bias voltages are applied to the anode and field emitter. Field emitter 40 has an extremely fine tip or edge 50 from which electrons are emitted in accordance with the Fowler-Nordheim electron tunneling phenomenon, when a suitably high electric field is created at the tip 50. An opening 55 extends at least from lateral field emitter 40 down to composite anode 30. Composite anode 30 comprises a layer of base material 35 on the top surface of substrate 20 and a phosphor portion 70 extending along the top surface of composite anode 30 and defining the extent of a lower-resistivity electron-sink portion 80. Electron-sink portion 80 may advantageously be made to have a very small area relative to the area of phosphor portion 70; the relative proportions of regions 70 and 80 in the drawings are not drawn to scale. Substrate 20 is preferably conductive for providing electrical contact to the anode. If an insulating substrate is used, an additional conductive layer (not shown) may be disposed between the insulating substrate and base material layer 35 and may be patterned to provide a buried anode contact (not shown) for applying the anode voltage and for carrying current to external circuitry. Device structures having such buried anode contacts and methods for making such structures are described in U.S. Pat. Nos. 5,644,188 and 5,630,741, the entire disclosure of each of which is incorporated herein by reference. FIG. 1 shows two lateral field emitters 40, and two emitter tips 50, to illustrate the advantage that a dual-emitter device can be made by the same process, with no additional process steps needed for the second emitter. However, the second emitter is not required for operation of the device, and the second emitter may be omitted. If the second emitter is omitted, electron sink region 80 may be positioned adjacent to the edge of opening 55 furthest from the remaining field emitter tip 50. Thus, for example, if the right-hand field emitter of FIG. 1 were omitted, electron-sink region 80 could advantageously be positioned adjacent to the right edge of opening 55, furthest from the remaining left emitter tip. (A single-emitter device structure illustrating such an arrangement is shown in FIG. 5, which also shows additional features, described in detail hereinbelow.)

Lateral field emitter 40 is separated from anode 30 by an insulating layer 60, which supports the lateral field emitter at a predetermined distance above the plane of the anode's top surface. A second insulating layer 90 may be disposed on top of field emitter 40. In principle, omission of second insulating layer 90 could improve viewing angles of the display, but practically the viewing angle improvement tends to be very slight, as only a thin insulating layer 90 is employed.

Figure 2:
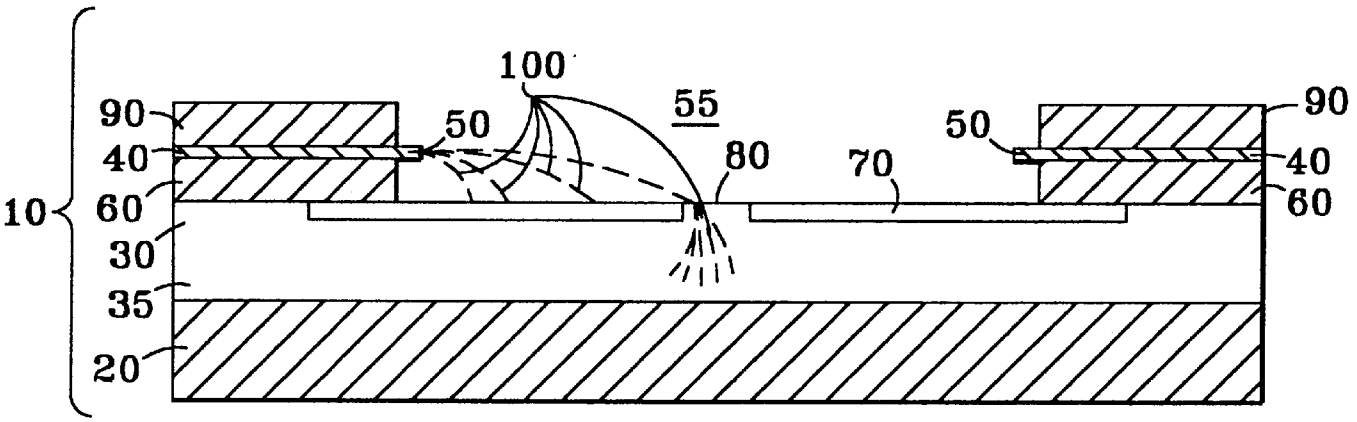
FIG. 2 shows a side cross-sectional view of a field-emission device illustrating electron paths.

Device structures made as shown in FIG. 1 have provided an unexpected result: electrons emitted from field-emitter tip 50 do not travel directly into the anode only near emitter tip 50. In this surface electron device, electrons apparently travel across the surface until they reach the lower-resistivity electron-sink region 80, where they enter the bulk material of anode base material 35. The overall beneficial effect is a bright pixel with a large effective fill factor, in which cathodoluminescence occurs not only in the vicinity of emitter tip 50, but also over the whole area of phosphor portion 70 at the bottom of trench opening 55. Means are provided for applying a suitable electrical bias to cause electron field emission from emitting edge 50 to composite anode 30, as known in the art. FIG. 2 shows a side cross-sectional view of a field-emission device, illustrating by dotted lines some electron paths 100 that may be typical in devices made in accordance with the invention. While such electron paths are believed to contribute to the improved performance observed from devices of the present invention, the invention is not intended to be limited by any particular physical phenomenon, but to be defined only by its structures and/or by the methods of its fabrication as set forth in the appended claims.

DESCRIPTION OF PREFERRED FABRICATION PROCESS

Figure 3:
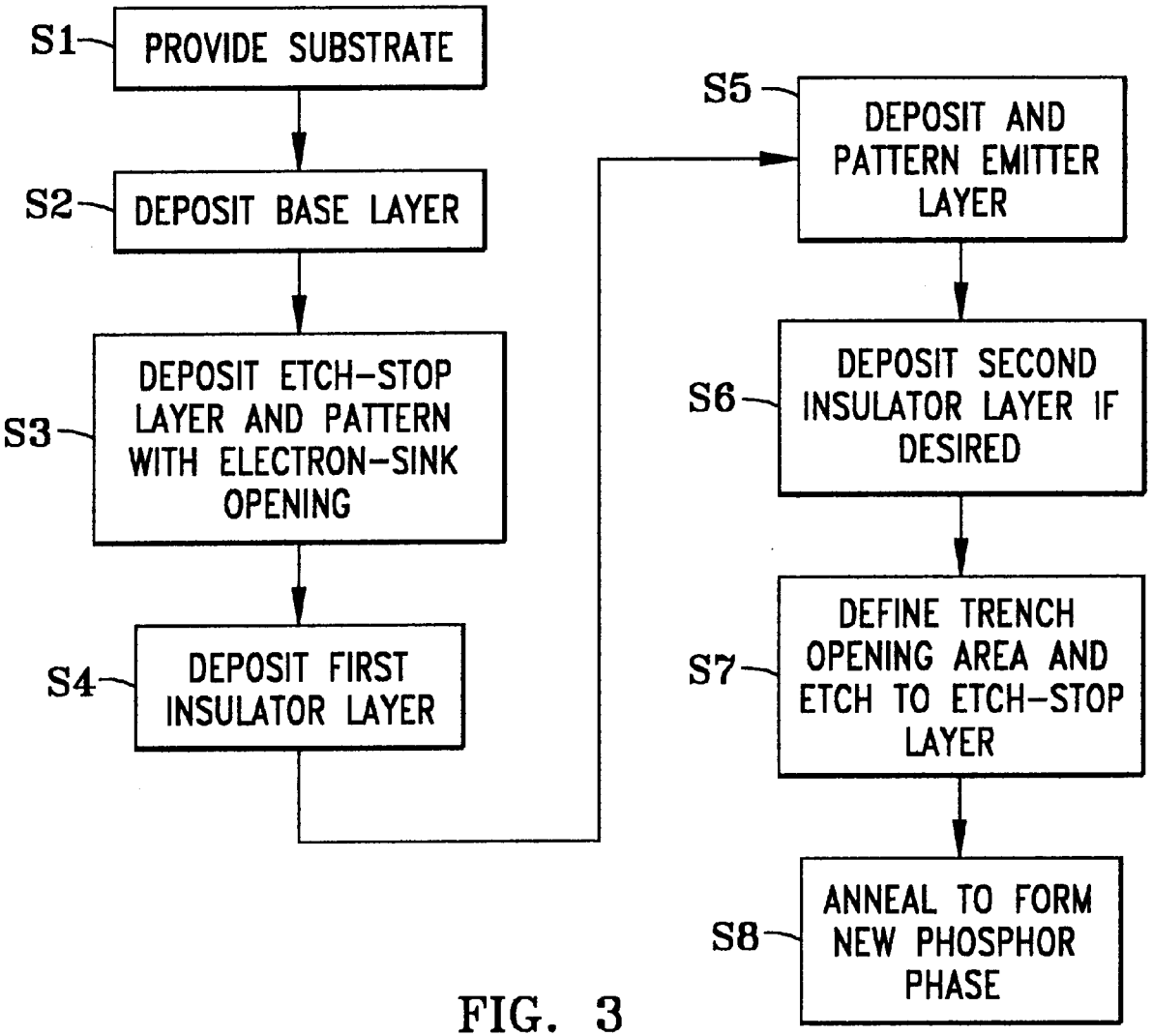
FIG. 3 shows a flow chart illustrating a preferred process for fabricating the field-emission device of FIG. 1.

FIG. 3 shows a flow chart illustrating a preferred process for fabricating the field-emission device of FIG. 1. FIGS. 4*a*–4*g* show a series of side elevation cross-sectional views illustrating results of the steps of the preferred process. In broad outline, the preferred process includes the overall steps of providing a substrate (S1), forming an anode having at least one electron sink region on the substrate (S2–S3, and S8), forming and patterning an electron emitter spaced apart from the anode and at least partially aligned with the anode (S5, S7), and disposing an insulating layer between the anode and the emitter (S4). This overall process is described in more detail in the following paragraphs.

Figure 4A:
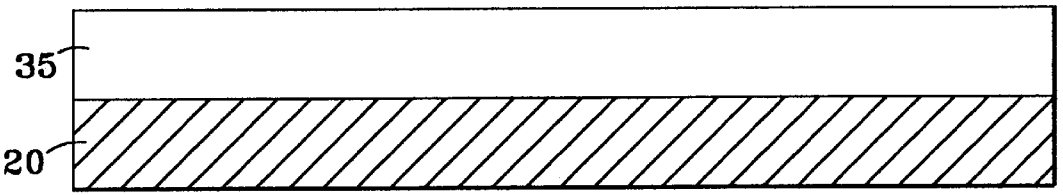
FIGS. 4*a*–4*g* show a series of side elevation cross-sectional views illustrating results of the steps of the preferred process for fabricating a field-emission device.
Figure 4B:
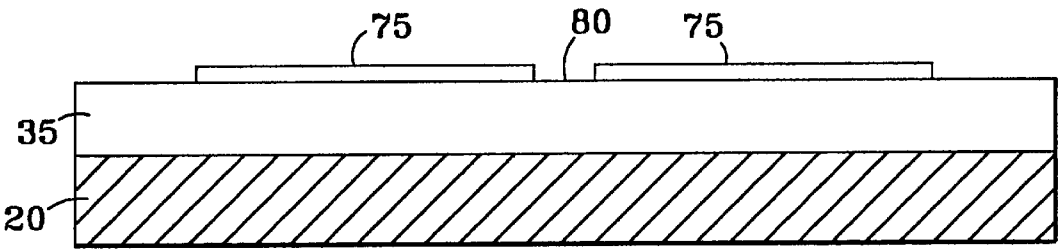
Figure 4C:
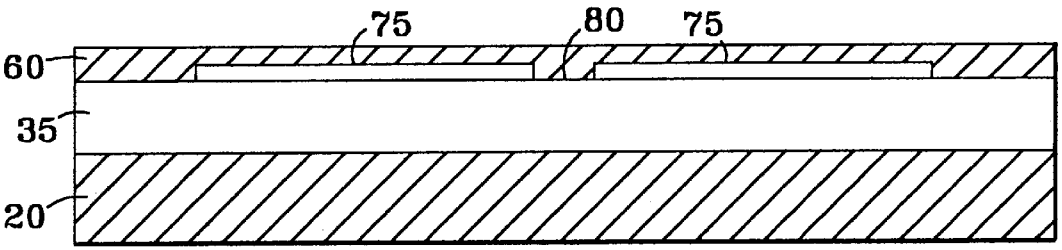
Figure 4D:
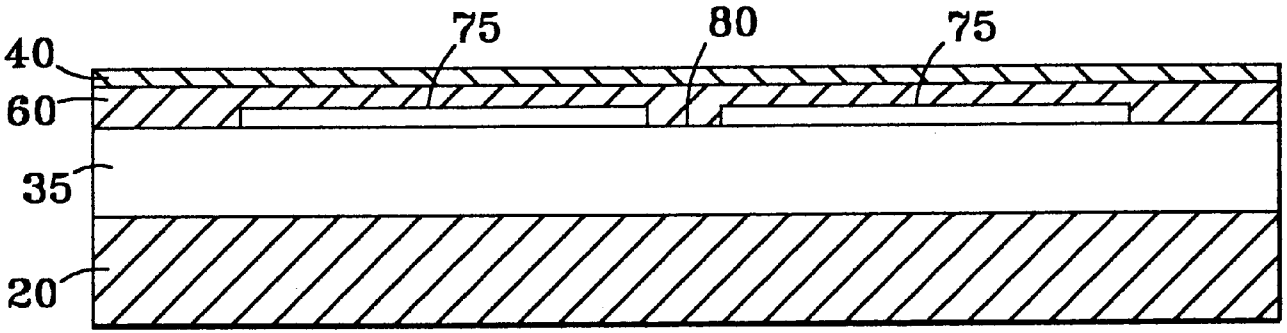
Figure 4E:
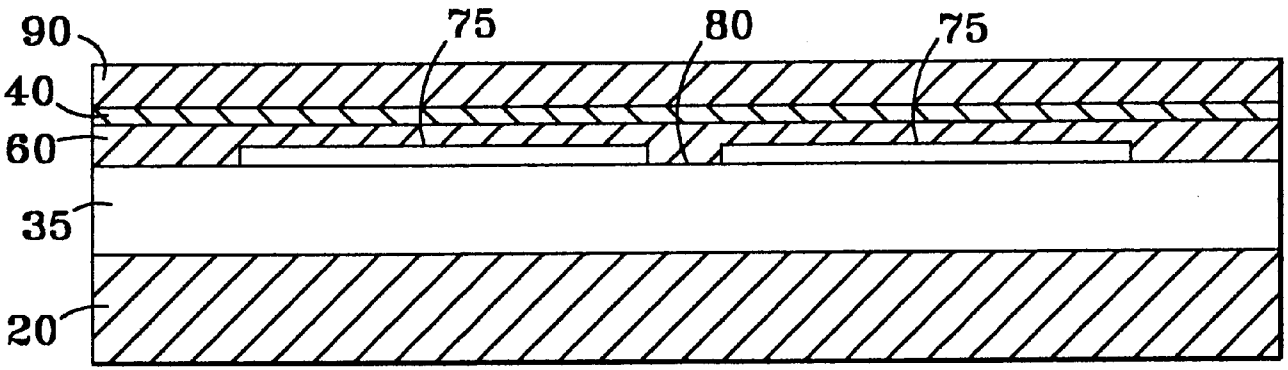
Figure 4F:
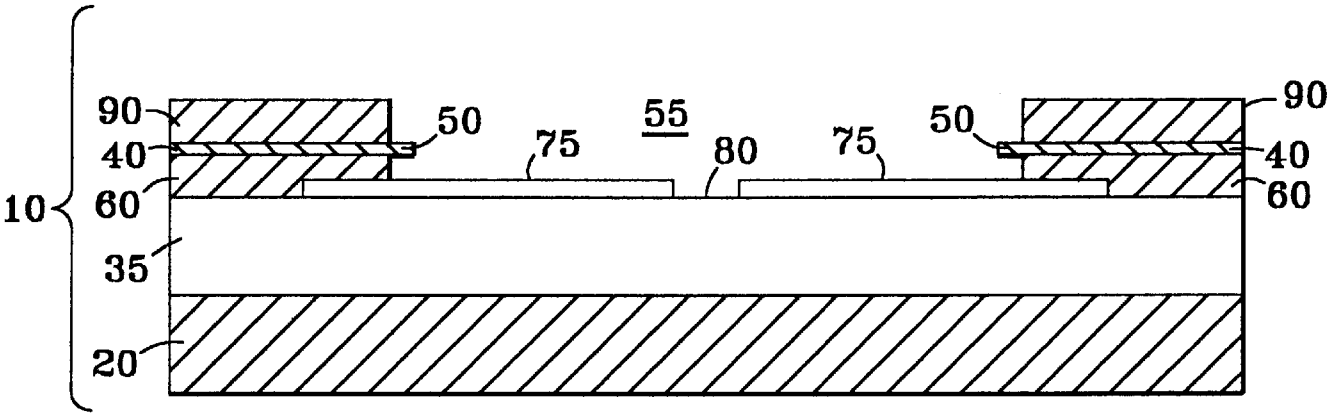
Figure 4G:
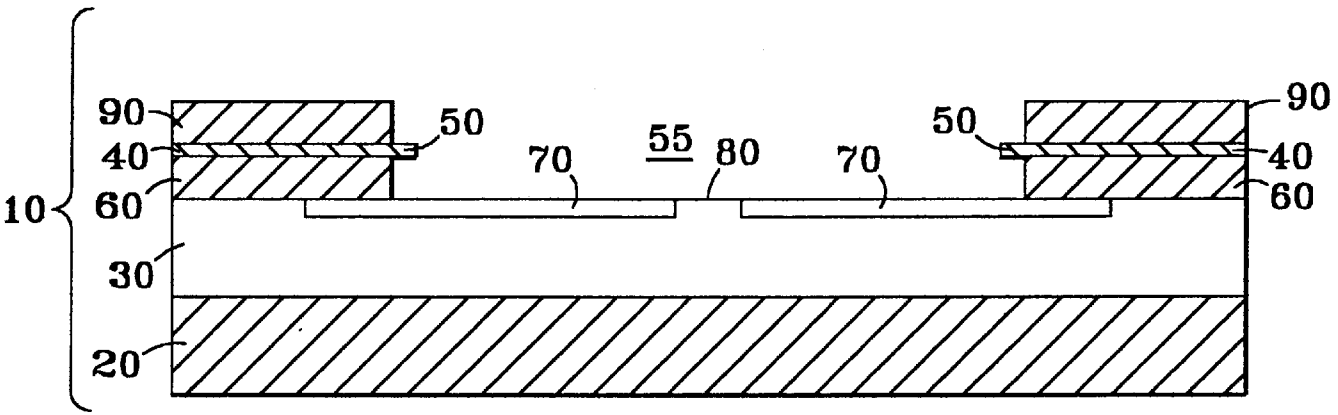

As shown in FIG. 3, the first step (S1) is providing a substrate 20, which may be silicon for example. In step S2, a base layer of a suitable first substance 35 is deposited (FIG. 4*a*). This first substance 35 is a cathodoluminescent phosphor, or a precursor substance that can be converted to a cathodoluminescent phosphor by heat treatment. A conductive or semiconductive phosphor should be selected, preferably with a resistivity of less than 200 microhm-centimeters. In the preferred embodiment, the base layer comprises ZnO:Zn, i.e. zinc oxide doped with excess zinc (in excess of a stoichiometric amount). In step S3, an etch-stop layer 75 is deposited and patterned (FIG. 4*b*) to form a first opening 80 that will define the locus of the electron-sink portion. The etch-stop layer 75 may be a refractory metal such as Ti, Zr, Hf, V, Nb, Ta, Cr, Mo, W, or combinations or alloys of these metals. In the preferred embodiment, the etch-stop layer comprises Ta. The depositing and patterning may be accomplished simultaneously by depositing the etch-stop material through a patterned mask. In step S4, a first insulator layer 60 is deposited (FIG. 4*c*). This may be a layer of silicon oxide, for example. In step S5, a thin emitter layer 40 is deposited (FIG. 4*d*) and patterned. In the preferred embodiment, the emitter layer is a layer of Mo of about 300 angstroms thickness. The material of the emitter layer preferably has a low work function. In step S6, a second insulator layer 90 is deposited if desired (FIG. 4*e*). This insulating layer 90 may also be of silicon oxide. In step S7, a second opening 55 through the emitter layer 40 and the first and second insulator layers (60 and 90) is formed by etching, while leaving the etch-stop layer 75 substantially un-etched (FIG. 4*f*). This etching is preferably performed using a conventional directional etching process such as reactive ion etching, sometimes called "trench etching" in the semiconductor fabrication literature. This step also forms the fine emitting tip 50 on emitter layer 40. In step S8, (FIG. 4*g*) the base layer 35 and etch-stop layer 75 are heated to form a phosphor 70 integral to an anode 30 having an electron-sink portion 80 located at the first opening. In the preferred embodiment, this heating of the ZnO:Zn base layer substance and the Ta etch-stop layer at a suitable temperature for a suitable time forms the phosphor $Ta_2Zn_3O_8$. Heating treatments at 900° C. for about one hour or more, or at 1200° C. for about 10 seconds or more, are examples of suitable heating treatments that have been used successfully for forming the phosphor $Ta_2Zn_3O_8$ of the preferred embodiment. This completes the fabrication of the electron field-emission device.

This fabrication process provides for fabricating a plurality of display element devices to make a flat panel display, by performing the steps described above simultaneously for as many display devices as needed for the flat panel display, arranged in a suitable array, with the emitter and/or anode electrical contact arranged in a suitable conventional matrix as known in the art.

FIG. 5 shows a side elevation cross-sectional view of an alternate embodiment of a field-emission device which has one or more control electrodes or gates (110, 120) for controlling the electron current flowing from emitter edge 50 to anode 30. While FIG. 5 shows two control electrode layers 110 and 120, disposed below and above emitter layer 40 respectively, functional devices may be made with only one control electrode layer (either control electrode layer 110 or control electrode layer 120) omitted. Control electrode layers 110 and 120 are fabricated by depositing and patterning conductive materials over insulating layers 60 and/or 90, and depositing additional suitable insulating layers such as insulating layer 130 as required to insulate the control electrode layers from other conductive elements. Fabrication steps for the control electrodes are not illustrated in FIGS. 3 and 4*a*–4*g*. Suitable fabrication processes and materials for the control electrodes are described in U.S. Pat. Nos. 5,644,188 and 5,630,741, incorporated hereinabove by reference. Means are provided for applying suitable electrical control signals to control electrodes 110 and/or 120.

As is apparent from the foregoing description, the invention is capable of being embodied with various alterations and modifications which may differ particularly from those that have been described in the preceding specification and description. Although specific embodiments of the present invention have been illustrated in the accompanying drawings and described in the foregoing detailed description, it will be understood that the invention is not limited to the particular embodiments described herein, but is capable of numerous rearrangements, modifications, and substitutions without departing from the scope of the invention. For example, the order of process steps may be varied, and materials having similar properties to those described may be substituted. In a particular example, to provide a color display, various phosphor materials having different colors of cathodoluminescence may be substituted for the phosphor materials of the particular embodiments described herein. The following claims are intended to encompass all such modifications.

Having described my invention, I claim:

1. A process for fabricating an electron field-emission device comprising the steps of:

a) providing a conductive substrate;

b) disposing a base layer on said conductive substrate, said base layer comprising a phosphor, or a precursor substance that can be converted to a phosphor by heat treatment;

c) disposing an etch-stop layer over said base layer;

d) patterning said etch-stop layer to form at least one first opening for an electron sink;

e) disposing a first insulator layer over said etch-stop layer;

f) disposing and patterning a conductive material to form an emitter layer of only a few hundred angstroms thickness over said first insulator layer;

g) disposing a second insulator layer over said emitter layer;

h) etching a second opening through said emitter layer and said first and second insulator layers while leaving said etch-stop layer substantially un-etched;

i) heating at least said base substance and etch-stop layer at a suitable temperature for a suitable time to form a composite material, thus forming an anode having at least one electron sink at said at least one first opening and completing the electron field-emission device.

2. A process for fabricating an electron field-emission device as in claim 1, wherein said conductive-substrate-providing step (a) is performed by providing a silicon substrate.

3. A process for fabricating an electron field-emission device as in claim 1, wherein said conductive-substrate-providing step (a) is performed by depositing a conductive material on another substrate.

4. A process for fabricating an electron field-emission device as in claim 1, wherein said layer of a suitable base substance is disposed by depositing a cathodoluminescent phosphor or a substance capable of being converted to a cathodoluminescent phosphor by heat treatment.

5. A process for fabricating an electron field-emission device as in claim 1, wherein said etch-stop layer is disposed by depositing a refractory metal.

6. A process for fabricating an electron field-emission device as in claim 1, wherein said first-insulator-layer-disposing step (e) is performed by depositing silicon oxide.

7. A process for fabricating an electron field-emission device as in claim 1, wherein said second-insulator-layer-disposing step (g) is performed by depositing silicon oxide.

8. A process for fabricating an electron field-emission device as in claim 1, wherein said second-opening-etching step (h) is performed by reactive ion etching.

9. A process for fabricating an electron field-emission device as in claim 1, wherein said emitter-layer-forming step (f) is performed by depositing and patterning a layer of metal.

10. A process for fabricating an electron field-emission device as in claim 1, wherein said base layer of a suitable substance comprises zinc-doped zinc oxide (ZnO:Zn), said etch-stop layer comprises tantalum (Ta), and said heating step (i) is performed by heating at a temperature of at least 900° C. for a suitable time to form $Ta_2Zn_3O_8$.

11. A process for fabricating an electron field-emission device as in claim 1, wherein said composite material comprises $Ta_2Zn_3O_8$.

12. A process for fabricating an electron field-emission device as in claim 3, further comprising the step of patterning said conductive material to form a patterned anode contact.

13. A process for fabricating an electron field-emission device as in claim 4, wherein said phosphor is zinc-doped zinc oxide, ZnO:Zn.

14. A process for fabricating an electron field-emission device as in claim 5, wherein said refractory metal is selected from Ti, Zr, Hf, V, Nb, Ta, Cr, Mo, W, and combinations and alloys thereof.

15. A process for fabricating an electron field-emission device as in claim 9, wherein said layer of metal comprises a layer of molybdenum (Mo) of about 300 angstroms thickness.

16. A process for fabricating an electron field-emission device as in claim 10, wherein said composite material comprises $Ta_2Zn_3O_8$.

17. A process for fabricating an electron field-emission device comprising the steps of:

a) providing a silicon substrate;

b) depositing a layer of a first substance comprising ZnO:Zn;

c) depositing an etch-stop layer of Ta;

d) patterning said etch-stop layer to form at least one first opening for an electron sink;

e) depositing a first insulator layer of silicon oxide;

f) depositing and patterning a layer of Mo to form an emitter layer of about 300 angstroms thickness;

g) depositing a second insulator layer of silicon oxide;

h) etching a second opening through said emitter layer and said first and second insulator layers while leaving said etch-stop layer substantially un-etched;

i) heating at least said ZnO:Zn substance and said etch-stop layer at a temperature of about 900° C. or higher for a suitable time to form $Ta_2Zn_3O_8$, thus forming an anode having at least one electron-sink portion located at said at least one first opening and completing the electron field-emission device.

18. A process for fabricating an electron field-emission device as in claim 17, wherein said heating step (i) comprises heating for at least about one hour.

19. A process for fabricating an electron field-emission device as in claim 17, wherein said heating step (i) comprises heating at a temperature of about 1200° C. or higher for at least about ten seconds.

20. A process for fabricating an electron field-emission device, comprising the steps of:

a) providing a substrate;

b) forming an anode on said substrate, said anode having at least one electron sink region, said electron sink region being formed by performing the substeps of
i) disposing an etch-stop layer on said anode,
ii) forming an opening in said etch-stop layer, and
iii) heating said anode;

c) forming and patterning an electron emitter spaced apart from said anode along a direction parallel to said substrate and at least partially aligned with said anode;

d) disposing an insulating layer between said anode and said emitter.

* * * * *